US006299434B1

(12) United States Patent
Sung

(10) Patent No.: US 6,299,434 B1
(45) **Date of Patent: *Oct. 9, 2001**

(54) DOUBLE-BUTTON PIEZOELECTRIC CHILD-RESISTANT CIGARETTE LIGHTER

(76) Inventor: Kil Yong Sung, 1434 Atherton Cir., Fullerton, CA (US) 92833

( * ) Notice: Subject to any disclaimer, the term of this patent is extended or adjusted under 35 U.S.C. 154(b) by 0 days.

This patent is subject to a terminal disclaimer.

(21) Appl. No.: 09/629,027

(22) Filed: Jul. 31, 2000

Related U.S. Application Data

(63) Continuation of application No. 09/494,225, filed on Dec. 2, 1999, now Pat. No. 6,095,796.

(51) Int. Cl.[7] ..... F23D 11/36
(52) U.S. Cl. ..... 431/153; 431/255
(58) Field of Search ..... 431/153, 255

(56) References Cited

U.S. PATENT DOCUMENTS 4,542,775 * 9/1985 Beck ..... 137/812
5,829,963 * 11/1998 Ichikawa ..... 431/153
5,839,892 * 11/1998 Hwang ..... 431/153
5,997,282 * 12/1999 Man ..... 431/153
6,010,328 * 1/2000 Sung ..... 431/153
6,039,561 * 3/2000 Lei ..... 431/153
6,086,358 * 7/2000 Potskhishvili et al. ..... 431/153
6,095,796 * 8/2000 Sung ..... 431/153
6,164,332 * 12/2000 Hatton ..... 137/812

FOREIGN PATENT DOCUMENTS

WO 99/46539 9/1999 (WO) .

* cited by examiner

*Primary Examiner*—Carl D. Price
(74) *Attorney, Agent, or Firm*—Trojan Law Offices

(57) ABSTRACT

A safety mechanism in a cigarette lighter that utilizes a double-button actuator system. The safety button has an aperture through which is positioned an ignition button. The safety button and the ignition button are adjoined by a flange such that when the safety button is depressed the ignition button is also depressed. The safety mechanism also includes a stopper which limits the downward movement of the safety button. Thus the safety button translates downward sufficiently to operate the fuel-release lever opening the fuel-discharge valve. However, in order to activate the piezoelectric unit the ignition button must be depressed below the level of the contact surface of the safety button.

12 Claims, 2 Drawing Sheets

DOUBLE-BUTTON PIEZOELECTRIC CHILD-RESISTANT CIGARETTE LIGHTER

This application is a continuing application of U.S. patent application Ser. No. 09/494,225, filed on Dec. 2, 1999, now U.S. Pat. No. 6,095,796.

BACKGROUND OF INVENTION

1. Field of Invention

This invention relates generally to cigarette lighters having a child-resistent mechanism and more specifically to lighters employing a double-button child-resistent mechanism.

2. Related art

Cigarette lighters containing piezoelectric units are very useful and have become quite prevalent in modern times. Cigarette lighters of the type described herein generally contain a lighter housing that is small enough to be held in the palm of an adult hand. The operation of piezoelectric cigarette lighters is somewhat simpler than that of the traditional flint/spark-wheel lighter. Generally, the lighter is operated by depressing an actuator button, which both activates the piezoelectric unit and acts on a fuel-release lever to release fuel. As a result, a flame is produced at a location opposite the actuator button. As is evident, this process avoids the need for operation of a spark wheel simultaneously with operation of a fuel-release button in order to generate a flame. Obviously, there is an advantage to the simplicity that is offered by piezoelectric cigarette lighters. On the other hand, in the hands of children, or others who do not know how to safely and properly operate the lighter, such lighters are as dangerous as any other spark and/or flame-producing device. Therefore, a need has been realized to equip cigarette lighters with safety features that minimize accidental or improper use by inexperienced persons, especially young children.

Many inventions have been created to address this safety-related concern. Generally, these inventions have sought to introduce safety mechanisms that disable operation of the actuator button of the lighter. As such, these lighters normally consist of a safety feature whereby the operational path of the actuator button is blocked by a latch, button, slide, or other blocking means. Proper operation of the lighter requires that the blocking means be moved out of the path of the actuator button, or other structure that might be integral with the actuator button, before a flame can be produced. Only then is the operator able to depress the actuator button and produce a flame. As such, the prior art requires additional structural members, as well as additional steps (e.g., lateral or longitudinal disengagement of a blocking means), to operate the lighter.

In some of the aforementioned cigarette lighters, the safety mechanism is passive. That is, once the safety feature is de-activated by moving the blocking member from the "locked" to the "unlocked" position, the lighter remains in the "unlocked" position, and thus is operable as a cigarette lighter with no safety feature at all. In these devices, the lighter remains in the "unlocked" position until the safety feature is activated again by manually re-engaging the safety mechanism (e.g., by manually returning the blocking means to the "locked" position).

In order to address this problem, some inventions have introduced safety mechanisms that are activated automatically after each use of the lighter. In general, this improvement has alleviated some of the fears associated with leaving the lighter in an "unlocked", operable position after the operator has finished using the lighter. Nevertheless, a disadvantage that is common to the passive, as well as the active, cigarette lighters is that their operation is usually quite cumbersome. Frequently, in order to use such cigarette lighters, the operator must use more than one finger, and sometimes more than one hand, to perform several functions simultaneously. As such, loss of ease of use is the price that is paid for any additional amount of safety that might be achieved.

Therefore, there is a need for a device that not only achieves the stated safety goals, but also is amenable to operation with relative ease. The invention described herein offers such a combination and consists of a safety button that is similar in size and physical location to the conventional activation button. The invention requires that an ignition button, located in a cavity within the safety button, be depressed simultaneously with the safety button before a flame can be produced. In this way, young children are coaxed into believing that they can operate the lighter in the usual way, i.e., by pressing only the safety button. However, such operation will produce neither a spark nor a flame. Moreover, given the relatively small size of the ignition button, operation of this button requires an amount of strength and pulp that are rarely found in the fingers of young children. At the same time, due to the placement of the ignition button, simultaneous operation of both the safety button and the ignition button requires use of only one finger, so that operation of the lighter by the intended adult user is no different from operation of a lighter with no safety mechanism at all.

SUMMARY OF THE INVENTION

The primary object of this invention is to provide a safety mechanism for cigarette lighters so that children, or inexperienced users, will be less likely to inadvertently activate the lighter. Such a safety feature is especially important because young children often play with lighters as toys and because lighters have mechanically moveable parts that make them attractive to children as toys.

A second object of the present invention is to provide an improved device for maximizing safety in cigarette lighters without compromising ease of use.

The invention meets its objectives by providing an ignition button that must be depressed in order for a spark and a flame to be produced. The ignition button is placed within a cavity in the lighter's safety button, parallel to the lighter's longitudinal axis, with only a small portion of the ignition button (i.e., the ignition button's operation section) extending outside of the safety button's contact surface. Typically, a young child will attempt to activate the lighter by depressing the safety button only. However, when this is done, neither a spark nor a flame will be generated as the safety button is stopped along its path by a stopper before the spark-producing mechanism can be activated. The stopper is permanently attached to the inner surface of the lighter housing, so that it cannot be removed out of the safety button's path. As such, repeated operation of the safety button by a child will yield the same unsuccessful results.

The only way to activate the lighter is to depress the ignition button. When this is done, initially, the ignition button and the safety button will move towards the bottom end of the lighter in unison. However, when the stopper engages the safety button, the operator must continue to depress the ignition button until the spark-producing mechanism is activated. This is a simple, yet effective concept. Nevertheless, it is a concept that a young child operating the lighter must recognize and grasp before he/she can successfully operate the lighter. In most cases, the child will not recognize the usefulness of the ignition button and will abandon the lighter after several unsuccessful attempts.

Moreover, even if a child does attain an appreciation for the interrelationship between the ignition button, the safety button, and the production of a flame, he/she will still have difficulty activating the lighter. The portion of the ignition button that is exposed (i.e., the ignition button operation section) is small relative to the size of the safety button. As such, it is more difficult to fully depress the ignition button than if the operator needed to depress only the larger, more-easily reachable, safety button. Thus, the single finger of a young child will not be able to fully depress the ignition button. Moreover, because of the smaller size and location of the ignition button, a child cannot use a plurality of fingers to try and depress the ignition button. As such, the strength needed to depress the ignition button, and the lack thereof in young children, itself acts as a deterrent in the present invention.

Furthermore, in order for the lighter to be successfully operated, the ignition button must be pressed in far enough so that the ignition button's operation section travels just past the safety button's contact surface. In order to achieve this task, the operator's finger must have enough pulp to depress the ignition button past the contact surface of the safety button. While an adult operator can easily perform this procedure, a child operator will have difficulty doing so. Hence, again, the structural configuration of the safety mechanism of the present invention acts as a deterrent to use by young children.

Finally, as can be understood from the above description, the invention disclosed herein achieves its safety objectives without making operation of the lighter any more cumbersome than a conventional piezoelectric cigarette lighter with no safety feature. Specifically, the ignition button is shaped and positioned in such a way that operation of the lighter is very simple in experienced hands. An adult user familiar with the operation of cigarette lighters need use only one finger and activate the lighter as he/she would normally by placing the finger on the safety and ignition buttons. This allows the user to operate the lighter in a safe, yet non-complicated manner.

This and other advantages of the present invention will become more apparent through the following description of the drawings and detailed description of the preferred embodiment.

DETAILED DESCRIPTION OF THE PREFERRED EMBODIMENT

Figure 3:
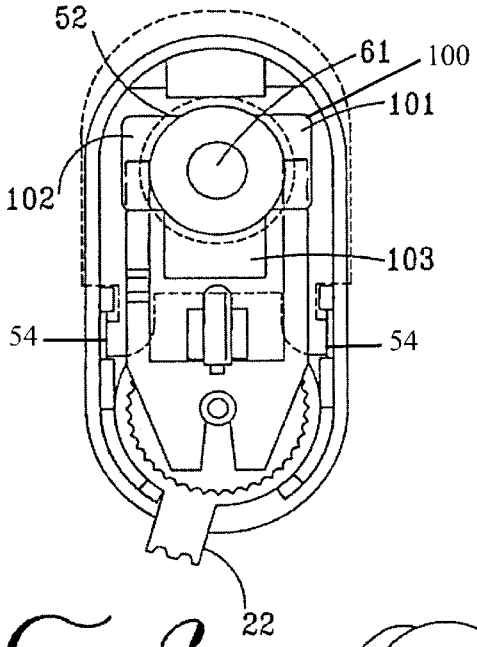
FIG. 3 is a top view of the preferred embodiment with the outline of the safety button and without the windscreen.
Figure 1:
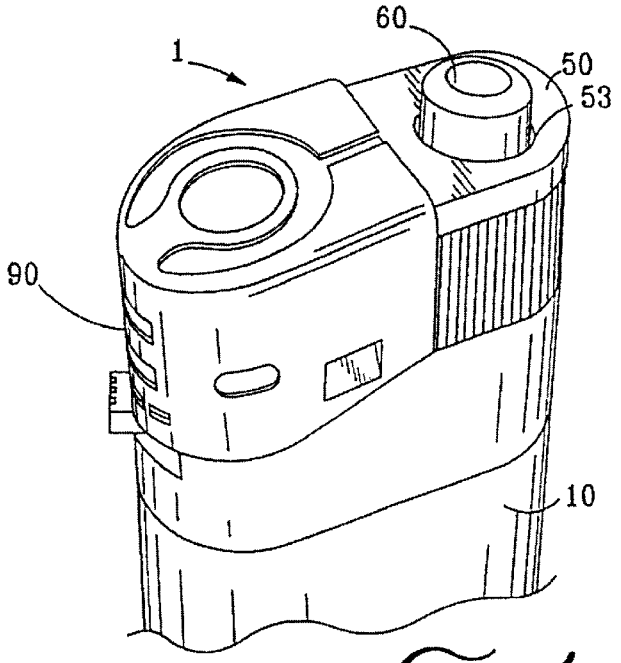
FIG. 1 is a perspective view of the preferred embodiment.
Figure 2:
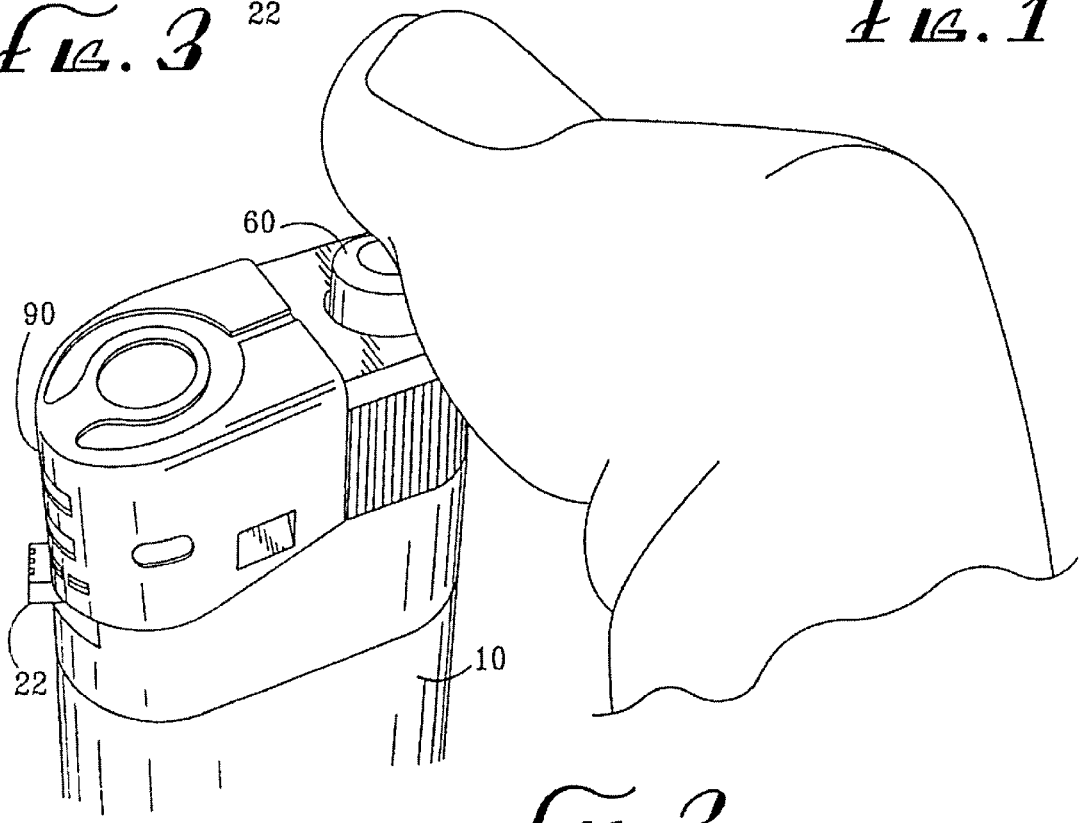
FIG. 2 is a perspective view with a thumb operating lighter.

A general description of the piezoelectric cigarette lighter (1) will be provided before presenting a detailed description of the safety feature that constitutes the invention.

The primary elements of the cigarette lighter (1) include a lighter housing (10), a fuel tank (20) which occupies the bottom portion of the lighter housing, a piezoelectric unit (30), an electric circuit connector (40), a safety button (50), an ignition button (60), a flange (100), a fuel-release lever (70) that translates the motion of the ignition button to open a fuel-discharge valve (21), a stopper (80) which acts to limit motion of the safety button, and a windscreen (90).

The lighter housing (10) of the lighter (1) has a cylindrical shape with a elliptical cross section, a bottom portion, and a top portion. A fuel tank (20) occupies substantially the bottom portion of the lighter housing (10) and contains conventional fuel, such as butane. Protruding from the top side of the fuel tank (20) is a fuel-discharge valve (21) which is spring loaded so that it is normally urged to the closed position. The valve is opened via the operation of a fuel-release lever (70). The lighter (1) is also equipped with a flame-adjusting wheel (22) which can be turned to adjust the amount of fuel released and, thus, the height of the resultant flame.

The next element of the lighter (1) is a piezoelectric unit (30). This unit is fitted within the top portion of the fuel tank and protrudes from said top portion, opposite the fuel-discharge valve (21). The piezoelectric unit has a lower section, which constitutes the piezoelectric housing (31), and an upper section, which constitutes the sliding section (32). Operation of the piezoelectric unit (30) creates an electric discharge that is carried to the fuel-discharge valve (21) via an electric circuit connector (40). The electric circuit connector (40) is generally made of material able to conduct electrical charge.

Another element of the lighter is the flange (100) that has an upper horizontal surface and two lower horizontal surfaces. The two lower horizontal surfaces (101 and 102) engage the fuel-release lever (70). The upper horizontal surface adjoins the ignition button and the safety button. The flange is located between the ignition button and the sliding section of the piezoelectric unit.

One of the primary elements of the child-resistant mechanism is the safety button (50). The safety button (50) is slidably mounted within the top portion of the lighter housing (10). The safety button (50) has integral guide arms (54) that allow the safety button to slide up and down along the longitudinal axis of, and relative to, the lighter housing (10). The safety button (50) has an contact surface (53) which has a generally flat surface, however, it is amenable to different degrees of curvature.

The next primary element is an ignition button (60). The ignition button (60) is slidably fitted within an aperture in the safety button (50) and has an operation section (61) that is exposed outside of the safety button contact surface (53). The ignition button (60) is of a generally round shape and is located above the sliding section of the piezoelectric unit.

The last primary element is the stopper (80). This is a projection that extends from the inner surface of the lighter housing (10), extending inward in a direction that is perpendicular to the longitudinal axis of the lighter (1). The stopper (80) functions by engaging and limiting the downward movement of the safety button (50).

Finally, the lighter (1) is equipped with a windscreen (90) which provides wind protection so that a flame is more easily generated, and less easily extinguished by wind. Moreover, the windscreen (90) holds the top portion of lighter (1) together by engaging the safety button (50) and the top portion of the lighter housing (10).

In the preferred embodiment, the primary elements of the safety-related invention described herein, as well as the interaction between these and the other, more conventional, elements of the cigarette lighter can be further defined as follows.

Figures 4A, 4B, 4C:
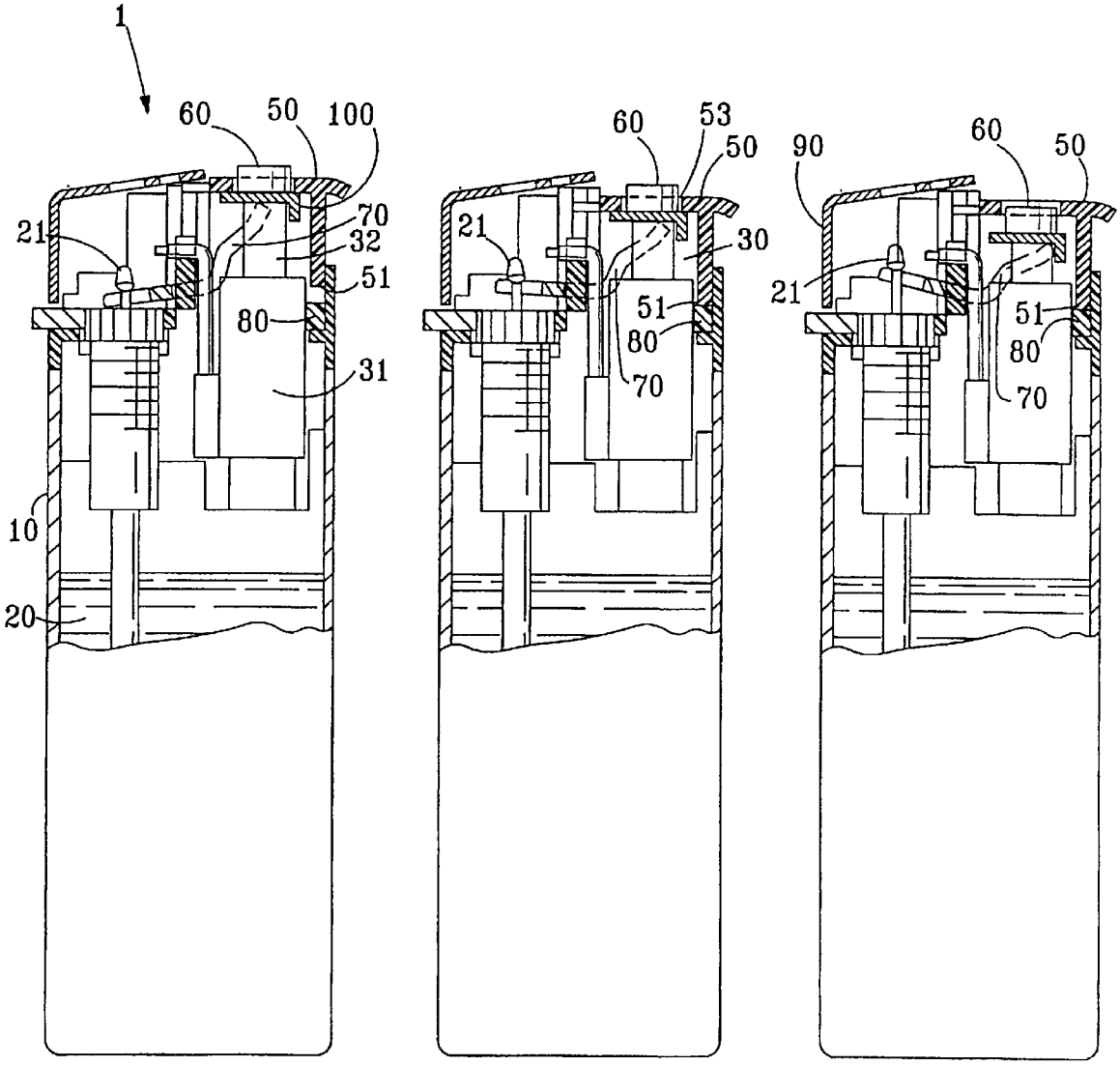
FIG. 4A is longitudinal cross-sectional view of the preferred embodiment.
FIG. 4B is the same view in the first stage of operation.
FIG. 4C is the same view in the second stage of operation.

In the preferred embodiment, the safety button (50) is slidably secured between the lighter housing (10) and the windscreen (90). The guide arms of the safety button allow the safety button to slide in a direction that is parallel to the longitudinal axis of the lighter (1). As shown in FIGS. 4A through 4C, the safety button (50) abuts the upper horizontal surface (103) of the flange (100). In this manner, whenever the safety button (50) is depressed, the flange and, thus, the sliding section (32) of the piezoelectric unit (30), also move in the same direction. Depressing the safety button results in activation of the fuel-discharge valve though the fuel-release lever.

Downward motion of the safety button (50) is limited, however, by the stopper (80). As shown in FIGS. 4A through 4C, the stopper (80) is a projection that extends inwardly from the inner surface of the lighter housing (10) and in a direction that is perpendicular to the longitudinal axis of the lighter (1). In the preferred embodiment, the stopper (80) is positioned so that it engages the bottom edge (51) of the back side of the safety button (50) as the safety button is depressed.

Activation of the piezoelectric unit (70) is achieved via operation of the ignition button (60). As shown in FIGS. 3 and 4, the ignition button (60) is slidably held within a space (52) defined parallel to the longitudinal axis of the safety button (50) and has an operation section (61) that protrudes through the contact surface (53) of the safety button (50). The ignition button (60) is fixedly attached to the top surface of the flange (100).

Although, in the diagrams depicting the preferred embodiment, the relative surface area of the operation section (61) of the ignition button (60) is shown to be approximately between one-third and one-half of that of the contact surface (53) of the safety button (50), this is not a requirement of the present invention. The smaller the cross-sectional area of the ignition button (60), the more difficult the operation of the lighter (1) for young children. As such, the relative sizes of the contact surface (53) and operation section (61) can be changed as dictated by safety requirements.

Also, in the preferred embodiment, the aperture (52) is located near the middle of the safety button (50). The invention described herein is not limited to this feature of the embodiment either. For example, the aperture (52) and the ignition button (60) can be located much closer to the windscreen (90). This would not diminish from the effectiveness of the safety feature or the ease of use of the lighter (1) for adult operators.

FIGS. 4A through 4C show the step-by-step operation of the preferred embodiment. The user operates the lighter (1) by depressing the operation section (61) of the ignition button (60). Initially, the ignition button (60) will move down slightly, until the surface of the operation section (61) of the ignition button (60) becomes parallel with the surface of the contact surface (53) of the safety button (50). As the user continues to apply downward pressure, both the ignition button (60) and the safety button (50) move in unison, until the stopper (80) engages the edge (51) of the safety button (50). As explained before, while this range of motion may be sufficient to open the fuel-discharge valve (21) via engagement of the fuel-release lever (70) by the flange (100), it is not enough to activate the piezoelectric unit (30). To achieve such activation, the user continues to depress the ignition button (60) below the contact surface (53) of the safety button (50). This requires that the user have sufficient pulp on his/her finger to push the operation section (61) of the ignition button (60) past the edge of, and inside, the aperture (52). This is a requirement that is rarely met in young children.

When the user releases the ignition button (60), the ignition button (60) returns to its original position by the urging force of a spring which is located in the piezoelectric unit (30). Also, as the sliding section (32) of the piezoelectric unit (30) moves upwards, the upper horizontal section (103) of the flange pushes up on the safety button (50), thereby disengaging the edge (51) of the safety button (50) from the stopper (80) and returning the safety button (50) to its original position.

With reference to FIGS. 1 through 4, it is noted that the invention disclosed herein is not to be limited by the embodiment shown in the figures and described in the description which is provided by way of example and not of limitation, but only in accordance with the scope of the appended claims.

I claim:

1. A lighter having a child-resistant mechanism, a lighter housing, which includes two protruding arms, a fuel reservoir, a piezoelectric unit, a fuel-discharge valve, and a fuel-release lever, the piezoelectric unit includes a housing and a sliding section, the fuel-release lever has a first and a second end, the first end of the fuel-release lever engages the fuel-discharge valve; the child-resistant mechanism comprising:

a safety button for operating the fuel-release lever, the safety button having a contact surface, the contact surface having an aperture;

an ignition button for activating the piezoelectric unit, the ignition button being located in the aperture of the contact surface of the safety button wherein the ignition button must be depressed below the contact surface of the safety button to activate the piezoelectric unit; and a stopper, projecting inward from the lighter housing, for limiting downward movement of the safety button, the safety button may be depressed until it engages the stopper thereby preventing the safety button from activating the piezoelectric unit.

2. The lighter of claim 1, wherein the safety button further comprises integrally formed guide arms slidably engaging the safety button to the two protruding arms of the lighter housing.

3. The lighter of claim 1, wherein the contact surface of the safety button is curved.

4. The lighter of claim 1, wherein the ignition button comprises:

a disk portion protruding through the aperture in the contact surface of the safety button;

an upper horizontal section for adjoining the disk portion to the safety button; and two lower horizontal sections for operating the fuel-release lever.

5. The lighter of claim 1, further comprising a windscreen.

6. A lighter having a child-resistant mechanism, a lighter housing, a fuel reservoir, a piezoelectric unit, a fuel-discharge valve, and a fuel-release lever, the piezoelectric unit includes a housing and a sliding section, the fuel-release lever has a first and a second end, the first end of the fuel-release lever engages the fuel-discharge valve; the child-resistant mechanism comprising:

a safety button having a contact surface and a bottom edge, the contact surface having an aperture;

an ignition button, located in the aperture of the contact surface of the safety button, for activating the piezoelectric unit;

a flange, located between the ignition button and the sliding section of the piezoelectric unit, for operating the fuel-release lever and adjoining the ignition button to the safety button, such that when the safety button is depressed a certain distance the ignition button is also depressed a similar distance; and a stopper, projecting inward from the lighter housing, for limiting downward movement of the safety button, the safety button may be depressed until the bottom edge of the safety button engages the stopper thereby preventing the safety button from activating the piezoelectric unit;

wherein the ignition button must be depressed below the contact surface of the safety button to activate the piezoelectric unit.

7. A The lighter of claim 6, wherein the safety button her comprises integrally formed guide arms for slidably engaging the safety button to the lighter housing.

8. The lighter of claim 6, wherein the contact surface of the safety button is curved.

9. The lighter of claim 6, wherein the ignition button is located above the sliding section of the piezoelectric unit.

10. The lighter of claim 6, wherein the flange has two lower horizontal surfaces for operating the fuel-release lever and an upper horizontal surface for adjoining the ignition button to the safety button.

11. The lighter of claim 6, further comprising a windscreen.

12. A lighter having a child-resistant mechanism, a lighter housing, fuel reservoir, a piezoelectric unit, a fuel-discharge valve, and a fuel-release lever, the piezoelectric unit includes a housing and a sliding section, the fuel-release lever has a first and a second end, the first end of the fuel-release lever engages the fuel-discharge valve; the child-resistant mechanism comprising:

a safety button having a contact surface and guide arms, the contact surface having an aperture;

an ignition button, located in the aperture of the contact surface of the safety button and located above the sliding section of the piezoelectric unit, for activating the piezoelectric unit, wherein the ignition button must be depressed below the contact surface of the safety button to activate the piezoelectric unit;

a flange, located between the ignition button and the sliding section of the piezoelectric unit, the flange having multiple lower horizontal surfaces for operating the fuel-release lever and an upper horizontal surface for adjoining the ignition button to the safety button whereby when the safety button is depressed a certain distance the ignition button is also depressed a similar distance; and a stopper, projecting inward from the lighter housing, for limiting downward movement of the safety button, the safety button may be depressed until it engages the stopper thereby preventing the safety button from activating the piezoelectric unit.

* * * * *